US008919162B2

(12) United States Patent
Moretto et al.

(10) Patent No.: US 8,919,162 B2
(45) Date of Patent: Dec. 30, 2014

(54) METHOD OF ROLLING A METAL STRIP WITH ADJUSTMENT OF THE LATERAL POSITION OF A STRIP AND SUITABLE ROLLING MILL

(75) Inventors: Christian Moretto, Hayange-St Nicolas en Foret (FR); Remi Bonidal, Metz (FR); Patrick Szczepanski, Metz (FR); Nils Naumann, Eisenhuttenstadt (DE); Jamal Daafouz, Ludres (FR); Claude Iung, Liverdun (FR); Uwe Koschack, Eisenhuttenstadt (DE)

(73) Assignee: ArcelorMittal France, Saint Denis (FR)

( * ) Notice: Subject to any disclaimer, the term of this patent is extended or adjusted under 35 U.S.C. 154(b) by 1296 days.

(21) Appl. No.: 12/663,943

(22) PCT Filed: May 27, 2008

(86) PCT No.: PCT/FR2008/000719

§ 371 (c)(1),
(2), (4) Date: Jun. 16, 2010

(87) PCT Pub. No.: WO2009/004155

PCT Pub. Date: Jan. 8, 2009

(65) Prior Publication Data

US 2010/0269556 A1 Oct. 28, 2010

(30) Foreign Application Priority Data

Jun. 11, 2007 (FR) ..... 07290719

(51) Int. Cl.

| | |
|---|---|
| ***B21B 37/68*** | (2006.01) |
| *B21B 1/26* | (2006.01) |
| *B21B 1/28* | (2006.01) |
| *B21B 38/00* | (2006.01) |

(52) U.S. Cl.

CPC . *B21B 37/68* (2013.01); *B21B 1/26* (2013.01); *B21B 1/28* (2013.01); *B21B 38/00* (2013.01); *B21B 2273/04* (2013.01)

USPC ..... 72/8.3; 72/11.1; 72/248

(58) Field of Classification Search

USPC ..... 72/8.1, 8.3, 8.4, 10.1, 10.4, 10.7, 11.1, 72/11.2, 248, 7.4, 9.3, 14.9, 15.3, 16.1, 72/16.2, 17.3, 18.1, 18.2, 20.4, 227; 700/150

See application file for complete search history.

(56) References Cited

U.S. PATENT DOCUMENTS 3,478,551 A * 11/1969 Alsop ..... 72/10.4
3,630,055 A * 12/1971 Fapiano et al. ..... 72/8.9

(Continued)

FOREIGN PATENT DOCUMENTS

DE 31 16 278 11/1982
DE 197 04 337 8/1998

(Continued)

*Primary Examiner* — Debra Sullivan

(74) *Attorney, Agent, or Firm* — Davidson, Davidson & Kappel, LLC

(57) ABSTRACT

A method of rolling a strip is provided. The method includes determining a value representative of the lateral position of the strip along a line transverse to a run direction downstream of each stand and calculating algebraic differences between the lateral positions and a reference position. A value of additional tilt is calculated from the algebraic differences to bring the algebraic differences below a predetermined threshold. Calculating the additional tilt values includes multiplying the algebraic differences by a gain matrix K that is determined by modeling relationships linking the algebraic differences and the tilts of the stand rolls. The additional tilt value is transmitted to each of the stands. The steps are repeated at predetermined time intervals until the strip is no longer gripped in the nip of the last stand of the rolling mill. A device for adjusting the lateral position of a strip is also provided.

21 Claims, 4 Drawing Sheets

(56) References Cited

U.S. PATENT DOCUMENTS

Figure 1:
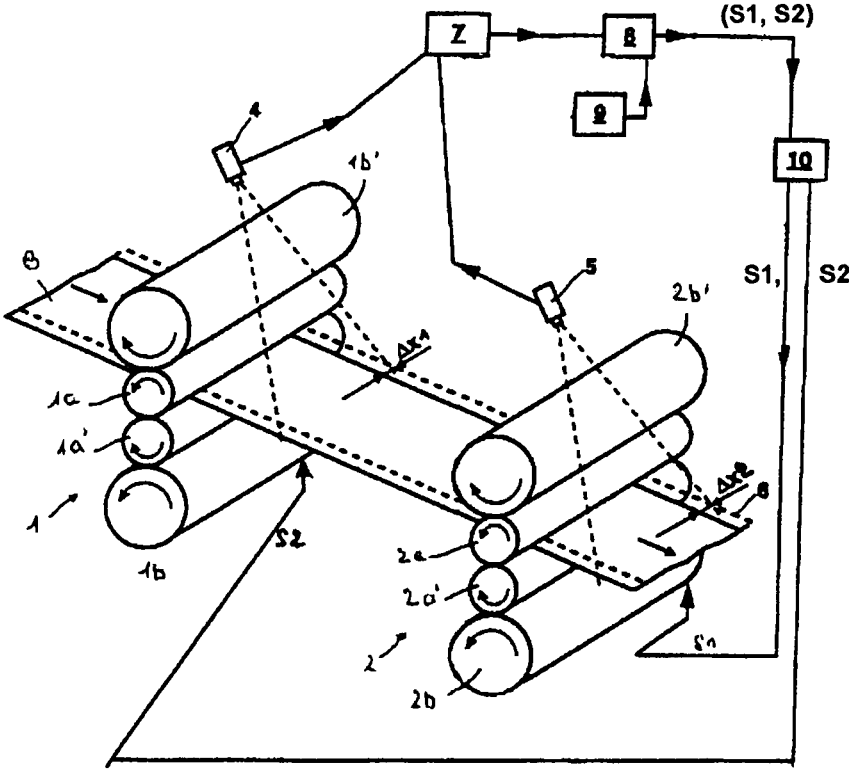

| | | | | | |
|---|---|---|---|---|---|
| 3,650,135 | A | * | 3/1972 | Skelton et al. | 72/8.9 |
| 3,733,866 | A | * | 5/1973 | Arimura et al. | 72/10.3 |
| 3,808,858 | A | * | 5/1974 | Connors et al. | 72/10.4 |
| 3,920,968 | A | * | 11/1975 | Imai et al. | 700/156 |
| 3,934,438 | A | * | 1/1976 | Arimura et al. | 72/9.3 |
| 4,404,634 | A | * | 9/1983 | Bautz | 700/150 |
| 4,583,384 | A | * | 4/1986 | Niino et al. | 72/9.2 |
| 4,700,312 | A | * | 10/1987 | Kikuma et al. | 700/150 |
| 4,790,164 | A | * | 12/1988 | Rothe | 72/10.1 |
| 5,187,959 | A | * | 2/1993 | Davi | 72/10.6 |
| 5,996,384 | A | | 12/1999 | Steeper et al. | |
| 6,012,319 | A | * | 1/2000 | Narita et al. | 72/241.2 |
| 6,082,161 | A | * | 7/2000 | Marushita et al. | 72/10.4 |
| 6,142,000 | A | * | 11/2000 | Rohde | 72/10.4 |
| 6,148,653 | A | * | 11/2000 | Sako et al. | 72/8.8 |
| 6,202,459 | B1 | * | 3/2001 | Palzer et al. | 72/8.9 |
| 6,227,021 | B1 | * | 5/2001 | Imanari | 72/12.3 |
| 6,286,349 | B1 | * | 9/2001 | Muller et al. | 72/11.7 |
| 6,349,581 | B1 | * | 2/2002 | Palzer et al. | 72/11.4 |
| 6,401,506 | B1 | * | 6/2002 | Ogawa et al. | 72/14.4 |
| 6,601,422 | B2 | * | 8/2003 | Hartmann et al. | 72/7.6 |
| 6,619,087 | B2 | * | 9/2003 | Ogawa et al. | 72/14.4 |
| 6,766,934 | B2 | * | 7/2004 | Ziegelaar et al. | 226/21 |
| 6,842,656 | B1 | * | 1/2005 | Burkhardt et al. | 700/110 |
| 7,050,875 | B2 | * | 5/2006 | Cribbs et al. | 700/110 |

FOREIGN PATENT DOCUMENTS

| | | | | |
|---|---|---|---|---|
| GB | 2 329 264 | | | 3/1999 |
| JP | 59 104206 | | | 6/1984 |
| JP | 60 210304 | | | 10/1985 |
| JP | 63188415 | A | | 8/1988 |
| JP | 02 020608 | | | 1/1990 |
| JP | 07 9002 | A | | 1/1995 |
| JP | 08 318305 | A | | 12/1996 |
| JP | 2003245708 | A | | 9/2003 |
| JP | 2005046900 | A | | 2/2005 |
| WO | WO 2007057098 | A1 | * | 5/2007 |

* cited by examiner

METHOD OF ROLLING A METAL STRIP WITH ADJUSTMENT OF THE LATERAL POSITION OF A STRIP AND SUITABLE ROLLING MILL

The invention relates to the rolling of metallurgical products. More precisely, it relates to a method of adjusting the lateral position of metal strip, especially steel strip, in a rolling mill.

Usually, hot-rolled steel strip is manufactured according to the following scheme:

- continuous casting of a slab 200 to 240 mm in thickness;
- reheating of the slab to a temperature of about 1100-1200° C.;
- passing of the slab through a roughing mill having a single reversible stand or a plurality of independent stands (for example five in number) placed one after another so as to obtain a strip having a thickness of about 30 to 50 mm; and
- passing of the strip through a finishing mill having a plurality of stands (for example six or seven in number) in which the strip is simultaneously present so as to give it a thickness of about 1.5 to 10 mm, after which the strip is wound into a coil.

The hot-rolled strip thus obtained may then be subjected to thermomechanical treatments that will give it its definitive properties, or may undergo cold-rolling which will further reduce its thickness, before the final thermomechanical treatments are carried out.

While it is being rolled, strip misalignments within the finishing mill are observed, that is to say the strip deviates from its nominal path between two stands. This deviation may be up to some thirty millimeters on either side of this nominal path if nothing is done to compensate for it. Strip misalignments may be due to incidents such as: wrinkles and fractures of the strip during rolling; refusal of the strip to be engaged in the nip of the rolls of a finishing mill stand; marking of the mill rolls after an impact with the strip. These defects may be due to the state of the strip itself or to the mechanical perturbations that its treatment under abnormal conditions involves during operation of the rolling mill. In addition, the misalignment worsens the thickness uniformity of the strip on leaving the finishing mill. Finally, it may impair the correct coiling of the strip.

These strip misalignments are also the cause of a shape defect called "warp": a strip with this defect, instead of being straight, is bowed in a horizontal plane. This defect is due to the existence of a wedge, i.e. a difference in thickness between the two edges of the rolled strip, the cause of which may be of thermal or mechanical origin if the reheating or the rolling is not carried out very uniformly over the entire width of the product.

Strip misalignments may be corrected using lateral guides placed between the rolling mill stands, against which guides the strip rubs when it deviates from its nominal path, said guides redirecting the strip toward said nominal path. However, when the misalignment becomes too great (in particular at the end of rolling, when the stand located just upstream of the stand in question has released the tail of the strip and therefore left it free to pivot toward that side of the stand where the nip of the rolls is greatest), the force that the guides must exert on the strip causes rubbing that damages its edges, sometimes going as far as to folding the edges over themselves, or to tear them. In addition, the guides wear out and have to be periodically replaced.

Various types of methods have been devised for adjusting the effect of strip misalignment. According to one of these methods (see document JP-A-4266414), the difference between the forces exerted on the two ends of the rolls is measured, and this difference is considered as an indicator of the extent of misalignment. As a consequence, the clamping force exerted by the rolls on the strip on that side where the misalignment occurs is increased, banking on the fact that this local increase in clamping force will bring the strip back to its reference position (i.e. generally along the axis of the rolling mill). However, this force difference measurement is sensitive to other factors than the misalignment of the strip, especially for the absolute value of the clamping force, and its absolute value cannot be strictly related to the amount of misalignment. Once the clamping force has been increased on one side of the stand, it is difficult to estimate what are the respective contributions of this modification of the clamping mode and of the actual reduction in misalignment in the variation of the measured difference between the forces exerted on the two ends of the rolls. Such a method of adjustment is therefore tricky to implement, since the corrective actions that it entails are not well suited for the intended purpose, sometimes to the point of worsening the strip misalignment that was intended to be corrected.

A second method of adjusting the strip misalignment consists in directly measuring the off-centering of the strip, as described in DE-3837101. For this purpose, a device, such as a diode camera provided with a reference frame, is placed between two stands of the rolling mill, said camera determining the absolute position of the strip relative to the axis of the rolling mill or any other reference position. Based on this information, the difference between the clamping forces exerted by the rolls of this stand on the two edges of the strip are varied, if necessary. As in the previous method, an increase in the clamping force on the side where the misalignment takes place tends to bring the strip back into its nominal position. Thus, if it is observed that the strip deviates toward the left, the clamping force is modified so as to deflect said strip to the right. It is possible to use a single strip off-centering measurement device or a plurality of such devices, each placed in a different interstand space. In such devices, the application of a predetermined additional clamping differential to a rolling mill stand depends only on the qualitative misalignment detected by means of the camera associated with the interstand space downstream of this stand. However, with such a method the final strip misalignment, on leaving the rolling mill, is very likely to be worse, since the misalignment is detected belatedly relative to its appearance. At the very least, this limits the effectiveness of the correction and possibly makes it counterproductive in the case of a sudden variation in the misalignment upstream of the stand in question. Furthermore, these methods do not allow real control of the amount of misalignment, only an approximate correction being applied.

The object of the invention is to provide a method of rolling a strip in a rolling mill for metal products, which enables the lateral position of this strip while it is being rolled to be effectively controlled, and to do so more accurately and rapidly than the existing methods, so as to avoid rolling incidents. An additional advantage would be to obtain a strip with no wedge defect and consequently no warp.

For this purpose, one subject of the invention is a method of rolling a strip in a rolling mill for metal products, which mill has at least two stands in the nips of which said strip is simultaneously gripped, whereby the lateral position of said strip is adjusted, said adjustment comprising the following operations:

- downstream of each of the stands of the rolling mill in the nips of which said strip is gripped, a value representative of the lateral position of the strip along a line transverse to its run direction is simultaneously determined and the algebraic differences (Δxp) between said lateral positions and a reference position are calculated;

the value (Sp) of the additional tilt to be imposed on each of said stands of the rolling mill, in the nips of which said strip (B) is gripped, is calculated from these differences (Δxp) so as to bring said algebraic differences (Δxp) below a predetermined threshold, the calculation of said additional tilt values (Sp) being carried out by multiplying said differences (Δxp) by a gain matrix K determined by modeling the relationships linking said differences (Δxp) of the strip and said tilts (Sp) of the support rolls of the rolling mill;

the respective additional tilt setting (Sp) is transmitted to each of said rolling mill stands; and said operations are repeated at predetermined time intervals until said strip is no longer gripped in the nip of the last stand of said rolling mill.

The method according to the invention may further comprise the following optional features, taken individually or in combination:

the reference position is chosen in such a way that the wedge of the strip is zero;

the gain matrix K is determined by taking into account at least one initial adjustment parameter of the rolling process and at least one characteristic of the strip (B) to be rolled;

the gain matrix K is constant until the strip is no longer gripped except in the nip of the first stand of the rolling mill;

the calculated value of the lateral position of the strip is obtained by using the parameters of the gain matrix K;

at least two of the values representative of the lateral position of the strip are values delivered by sensors placed downstream of the corresponding rolling mill stands;

at least one of the values representative of the lateral position of the strip is a value calculated from the values delivered by said sensors placed downstream of the other rolling mill stands, the other representative values being the values delivered by the sensors;

all the values representative of the lateral position of the strip are values measured by the sensors, one in number downstream of each stand of the rolling mill;

the values delivered by the sensors are obtained by filtering the raw acquisition signals, the filtering taking into account the calculated differences (Δxp) between the lateral positions of the strip and the reference position;

when an additional tilt (Sp) to be imposed is below a predetermined threshold, no additional tilt setting is transmitted to the stand in question;

when the strip is no longer gripped in the nip of the first stand of the rolling mill, the lateral position of that part of the strip still gripped in the nips of at least two stands of the rolling mill and the pivot angle relative to the rolling axis of the tail of the strip are both adjusted, by calculating and transmitting an additional tilt value to each stand in which the strip is still present;

for each stand, the additional tilt value to be applied is determined using a value representative of the pivot angle of the tail of the strip upon entering the stand; and the value representative of said pivot angle is calculated by means of values representative of the lateral position of the strip along a line transverse to its run direction, in said stands in the nips of which the strip is gripped, said representative values being obtained according to the invention.

Another subject of the invention is a device for adjusting the lateral position of a strip in a rolling mill for metal products, which mill has at least two stands, in the nips of which the strip is simultaneously gripped, said device comprising:

at least two sensors delivering a raw acquisition signal for determining values representative of the lateral position of the strip along a line transverse to its run direction downstream of at least two stands of the rolling mill;

means for determining the algebraic differences (Δxp) between the representative values and a reference position;

means for calculating the value (Sp) of the additional tilt to be imposed on each of the stands of the rolling mill from the differences (Δxp) so as to bring the algebraic differences (Δxp) below a predetermined threshold;

means for calculating a gain matrix K which makes it possible to obtain the additional tilt values (Sp) by multiplying the differences (Δxp) by the matrix K; and means for transmitting the respective additional tilt setting (Sp) to each of the rolling mill stands at predetermined time intervals.

The device according to the invention may further include means for filtering the raw acquisition signals from the sensors.

Another subject of the invention is a device for adjusting the position of the tail of a strip in a rolling mill for metal products, which mill has at least two stands, said device comprising:

means for calculating the pivot angle of the tail of the strip with respect to the rolling axis;

means for calculating the value of the additional tilt to be imposed on each of the stands of the rolling mill so as to bring the value of the pivot angle below a predetermined threshold; and means for transmitting the respective additional tilt setting (Sp) to each of the rolling mill stands at predetermined time intervals.

Finally, the invention relates to a rolling mill, for rolling metal products in strip form, of the type having at least two stands and at least one device for adjusting the lateral position of the strip of the type according to the invention. This rolling mill may further include at least one device for adjusting the position of the tail of the strip according to the invention.

The rolling mill according to the invention may furthermore include the following optional features, taken individually or in combination:

the rolling mill may be a finishing mill for the hot rolling of steel strip;

the rolling mill may comprise two, five, six or seven rolling stands; and the rolling mill may be a mill for the cold rolling or skin-pass rolling of steel strip.

As will have been understood, the invention firstly consists in controlling the misalignment of the strip by imposing an additional tilt at each stand of the rolling mill between which the strip is tensioned, each tilt being calculated from values representative of the misalignment of the strip in all the inter-stand zones. This method thus makes it possible to combine the effectiveness of the control with speed of the control, without any risk to the strip or to the rolling mill. The term "tilt" is understood here to mean the difference in the positioning of the clamping members between the "operator" side and the "driving" side. This tilt value may be adjusted by clamping the ends of the backup rolls more or less.

Figure 2:
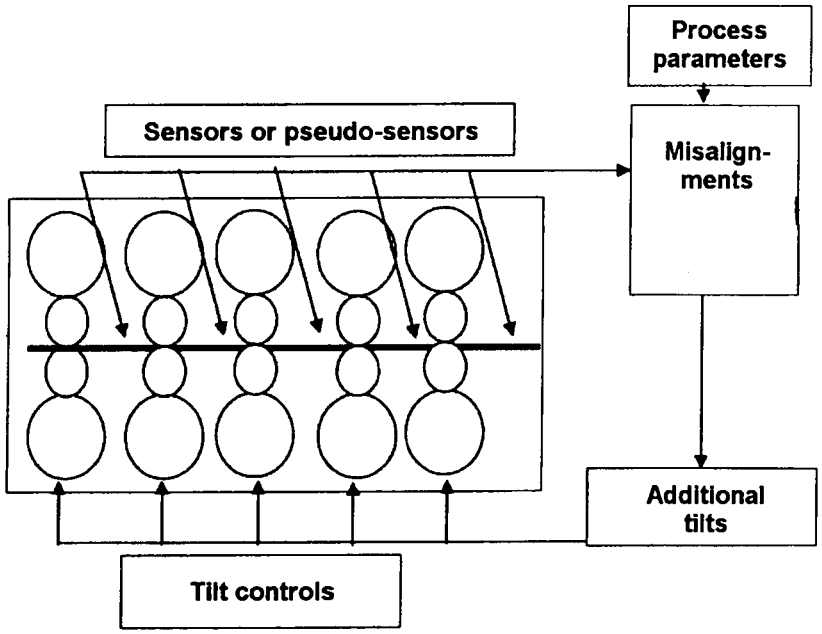
Figure 3:
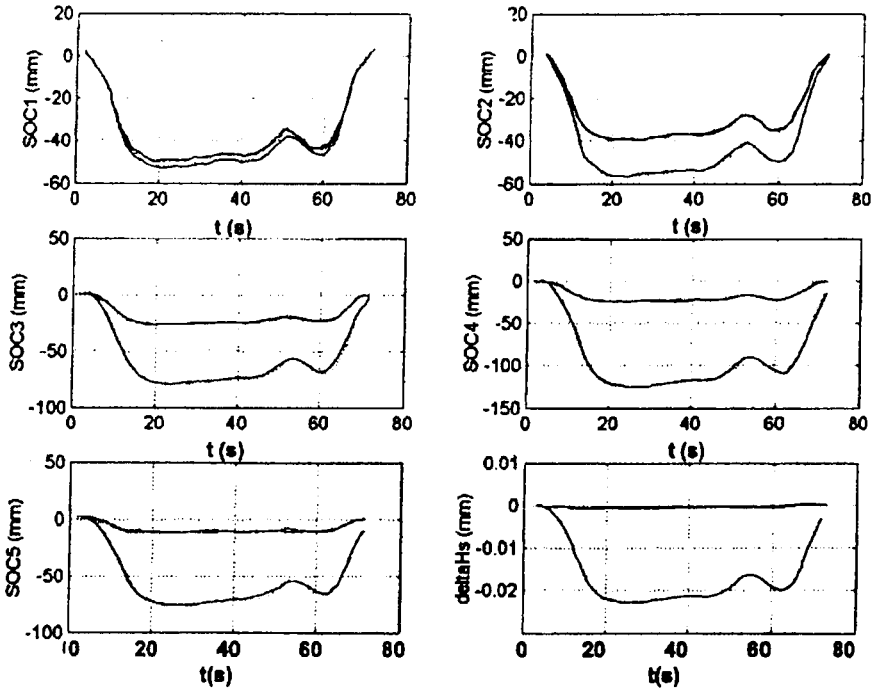
Figure 4:
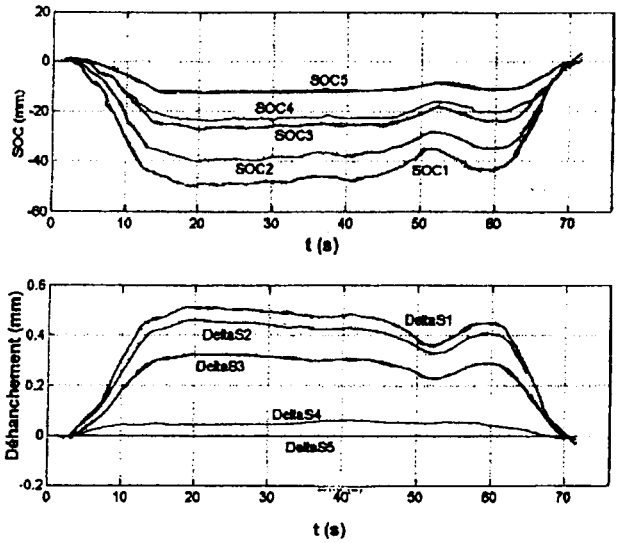
Figure 5:
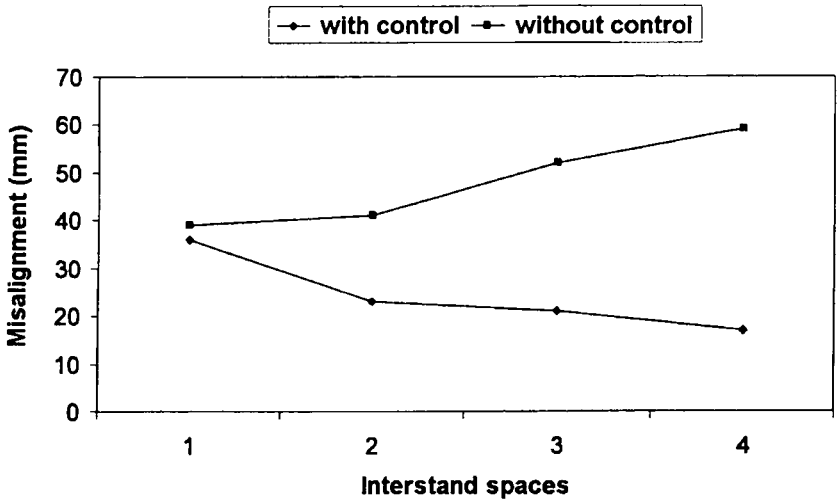

The invention will be better understood on reading the following description, given with reference to the appended figures:

FIG. 1: a diagram of a two-stand rolling mill equipped with an adjustment device according to the invention;

FIG. 2: a diagram of a five-stand rolling mill equipped with an adjustment device according to the invention;

FIG. 3: five curves simulating the misalignments at the exit of each stand of the rolling mill of FIG. 2 plotted as a function of time for a first strip rolled according to the invention and a second strip rolled according to the prior art, and a curve showing the residual wedge at the exit of the rolling mill for both these strips;

FIG. 4: first curves simulating the variation in misalignment at the exit of each stand of the rolling mill of FIG. 2, plotted as a function of time, and second curves showing the additional tilts applied to each stand, having obtained the differences shown in the first curves; and FIG. 5: curves showing the variation in misalignment in each interstand space when the method is implemented according to the invention ("with control" curve) and according to the prior art ("without control" curve).

FIG. 1 shows a metal strip B in the process of being rolled in a rolling mill having two stands 1, 2 in the nips of which the strip B is simultaneously gripped, for example a finishing mill for the hot rolling of steel strip. Rolling mills of this type generally have 5, 6 or 7 stands. Each stand 1, 2 conventionally comprises two work rolls 1*a*, 1*a*', 2*a*, 2*a*' and two backup rolls 1*b*, 1*b*' 2*b*, 2*b*'.

According to the invention, a first sensor 4 (such as a diode camera, or any other apparatus of equivalent function) which acquires a raw signal enabling in the end a value representative of the position of the strip B, along a line transverse to its run direction, between the stand 1 and the stand 2 to be determined, and a second sensor 5, similar to the first one, which carries out the same operation downstream of the stand 2.

The dotted lines 6 represent a reference position that the strip B should normally occupy when there is no misalignment. This reference position is generally centered on the theoretical geometric axis of the rolling mill. However, it may be advantageous to choose a different reference position so as to minimize the residual wedge of the strip B on exiting the rolling mill. This may in particular be the case when the geometric axis of the rolling mill is not coincident with the axis along which the rolling actually takes place. Whatever the case may be, it has been verified that determining this reference position has no influence on the control of strip misalignment, but only on residual wedge.

This reference position 6 is stored in memory in a first processing unit 7 to which the raw signals captured by the sensors 4, 5 are sent, this first processing unit 7 determining the algebraic differences Δx1 and Δx2 between the positions of the strip B recorded by the sensors 4 and 5 respectively and the reference position 6.

Depending on the type of sensor 4, 5 used, the processing unit 7 may have to process the raw signal from the sensor so as to obtain a value representative of the position of the strip B. Thus, if the sensors 4, 5 are CCD-type matrix cameras, the acquisition signal consists of an image of the area covered by the camera. In order to position the strip B, the signal may then be processed using appropriate software in order to filter the active pixels and detect the profiles of the strip B and thus determine its lateral position.

The sensors 4 and 5 are preferably positioned perpendicular to their respective measurement zones and have to be fixed to supports that are independent of the rolling mill and subject to the least possible vibration. Advantageously, the sensor 5 may be used both for controlling the misalignment of the strip B but also for measuring its width on exiting the rolling mill.

The calculated differences Δx1 and Δx2 are then sent to a second processing unit 8, which calculates the additional tilts S1 and S2 that have to be imposed on the stands 1 and 2.

The calculation of S1 and S2 is carried out by multiplying the differences Δx1 and Δx2 by a gain matrix K. A third processing unit 9 has the function of determining this gain matrix K that will be sent to the calculating unit 8.

The gain matrix K is obtained by modeling the relationships linking the misalignments of the strip to the tilts of the backup rolls of the rolling mill. This matrix may in particular be determined by trials carried out prior to the actual production run.

This modeling may take into account one or more quantities characteristic of the rolling process, such as the width of the rolls, the rolling force, the rotation speed of the work rolls, etc.

It may also take into account one or more parameters of the strip to be rolled, such as the thickness of the strip on entering the mill, its hardness, its temperature, etc.

It is thus possible to use average matrices determined by rolling different products representative of the production range, or else matrices specific to one particular product, thereby increasing precision.

The gain matrix K remains constant during the process of rolling a strip B, at least as long as the strip remains in the nip of the first rolling mill stand, only the values representative of the strip misalignment then being modified at each new data acquisition cycle by the sensors 4 and 5. When the strip leaves the nip of the first rolling mill stand, a modified gain matrix may be used that takes into account the fact that the strip is now gripped only in the nips of the N−1 stands, where N is the total number of stands. Likewise, it is possible to change the gain matrix progressively as the strip leaves the successive nips of the rolling mill stands, for better control of the misalignment.

The clamping force settings S1 and S2 may then be transmitted to means 10 for transmitting the settings that will be imposed on the actuators that control the tilt of the stands 1 and 2 (which actuators are of a type known per se, but shown in FIG. 1).

The method according to the invention makes it possible for the lateral misalignments of the strip, relative to its nominal position, to be controlled and to fall below the 10 mm threshold, whereas in the methods of the prior art said misalignments cannot fall below the 20 mm threshold.

When the calculation of the tilts S1 and S2 to be imposed on the rolling mill stands results in values below a predetermined threshold, provision may be made for no setting to be transmitted to the means 10. This provision thus applies in particular when the expected misalignment after implementing the additional tilts S1 and S2 does not exceed for example 2 mm.

The adjustment cycle may be repeated, for example every 50 or 100 ms, the frequency preferably being chosen so as to ensure good adjustment stability.

Since the mathematical models used to relate the misalignment to the additional tilt to be imposed on the rolling mill stands are valid as long as the strip in question is under tension between two stands, it is possible to continue controlling the lateral position of the strip until it is no longer gripped, except in the nip of the last stand. In this case, only the lateral position of that part of the strip still in the nip of at least two stands of the rolling mill, also called the "strip body", is controlled, of course by acting only on the stands in which the strip is still present.

It may then advantageous for that part of the strip upstream of the strip body, also called the "strip tail", to be controlled at the same time. This is because that part of the strip is capable of pivoting relative to the rolling axis and may even form wrinkles that will damage the work rolls of the rolling mill.

To adjust it, a value of the pivot angle upstream of each stand may firstly be calculated, preferably using the values representative of the misalignment of the strip body that have been acquired or calculated beforehand. What is therefore produced is a novel "pseudo-sensor" without additional equipment.

Starting from the values representative of the misalignment of the strip body in each interstand space and the pivot angle of the strip tail upstream of each stand, it is then possible to determine the additional overall tilt to be imposed on the stands in which the strip is still present, so as to control both the pivot angles of the strip tail and the lateral position of the strip body in each interstand space.

Now considering FIG. 2, which shows schematically a five-stand rolling mill provided with an adjustment device according to the invention, it should be stated that five values representative of the strip misalignment are also determined here, namely one per interstand space plus one downstream of the last stand of the rolling mill.

In order for the strip misalignment to be effectively controlled in the zones where it is under tension between two stands, the present inventors have found that it is necessary to have at least two real sensors that can give a signal representative of the position of the strip in the corresponding interstand space.

However, they have also found that it is possible to use this data delivered by the at least two real sensors that are present, in order to obtain values representative of the strip misalignment in the other interstand spaces, in the manner of pseudo-sensors.

Depending on the number of pseudo-sensors and their positions along the rolling line, the results in terms of controlling the strip misalignment are equivalent or very slightly inferior to those when controlling with one real sensor per interstand space.

The use of these pseudo-sensors may help to alleviate the effect of one or more sensors installed on the line failing when they break down during a production run or when the transmitted signal cannot be used because of the actual process conditions. Thus, this may happen in the zones where descaling has taken place, generating a dense vapor that disrupts the operation of the CCD cameras for example.

This use may also allow the number of real sensors installed on the line to be limited, thus reducing the investment cost and the maintenance cost of the device.

When the rolling method according to the invention is carried out in a mill having five or more stands, it is preferable not to impose additional tilt on the last stand of the mill, for the sake of safety, as it is no longer possible to rectify the misalignment of that part of the strip leaving the mill in the event of an anomaly due, for example, to the equipment.

We now consider FIG. 3, which shows five series of curves representing a simulation of the misalignments at the exit of each stand of the rolling mill of FIG. 2 (curves SOC1 to SOC5), plotted as a function of time, for a first strip rolled according to the invention (upper curve) and a second strip, rolled according to the prior art (lower curve), and a series of two curves representing the residual wedge at the exit of the rolling mill for a strip rolled according to the invention (upper curve) and the strip rolled according to the prior art (lower curve).

It may be seen that, with the method according to the invention, the misalignment of the strip is progressively controlled so as to achieve a stable level, below the 10 mm threshold, whereas the misalignment of the strip treated according to the prior art is not stabilized and systematically exceeds 50 mm.

The curve representing the wedge simulation is also indicative, since a zero wedge is obtained in the case of the strip treated according to the invention, whereas the wedge is considerable and irregular in the case of the strip treated according to the prior art.

FIG. 4 corresponds to the same simulations and repeats, in the upper part, the five misalignment curves of the strip according to the invention plotted as a function of time. It also shows, in the lower part, the additional tilt curves (delta S1 to delta S5) imposed on each of the five stands of the rolling mill over the course of time, making it possible to control the misalignment and the final wedge in the case of the strip treated according to the invention. This figure thus shows that, by varying these additional tilts depending on the amount of misalignment in each interstand space, it is possible in the end to successfully rectify the large initial misalignments existing because of heterogeneity due to the process. In so doing, the residual wedge, which may moreover be the cause of localized misalignment, is also rectified.

A trial was then carried out under actual conditions of the rolling method according to the invention on a five-stand finishing mill, the results of which are shown in FIG. 5.

The curves presented therein show the variation in the misalignment in each interstand space when the method is implemented according to the invention ("with control" curve) and according to the prior art ("without control" curve). Here again, it is confirmed that the method according to the invention enables the misalignment to be controlled, which in the end may thus be lowered from 37 to 10 mm, when this is measured meters from the exit of the finishing train. As regards the method according to the prior art, this does not enable the misalignment to be controlled, which increases systematically. In the end, a 63% reduction in the misalignment is observed between the strip treated according to the invention and that treated according to the prior art, although the initial amounts of misalignment at the exit of the first stand were very similar.

The invention is applicable in the first place to finishing mills for the hot rolling of steel strip. However, it may find applications in other types of rolling mills for metal strip having at least two stands in the nips of which the strip is simultaneously gripped. Thus, the invention may be implemented for the cold rolling or skin-pass rolling of metal strip, such as steel, ferrous or nonferrous alloy or even aluminum strip.

The invention claimed is:

1. A method of rolling a strip in a rolling mill for metal products, which mill has at least two stands in the nips of which said strip is simultaneously gripped, whereby a lateral position of said strip is adjusted, said adjustment comprising the following steps:

simultaneously determining a value representative of the lateral position of the strip along a line transverse to a run direction downstream of each of the stands in the nips of which the strip is gripped and calculating algebraic differences between the lateral positions and a reference position;

calculating a value of additional tilt to be imposed on each of the stands from the algebraic differences so as to bring the algebraic differences below a predetermined threshold, the calculating of the additional tilt values including multiplying the algebraic differences by a gain matrix K determined by modeling relationships linking the algebraic differences of the strip and the tilts of the stand rolls of the rolling mill;

transmitting respective additional tilt values to each of the rolling mill stands; and repeating the steps at predetermined time intervals until the strip is no longer gripped in the nips of the last stand of the rolling mill.

2. The method as claimed in claim 1, whereby said reference position is chosen in such a way that a wedge of said strip is zero.

3. The method as claimed in claim 1, whereby said gain matrix K is constant until said strip is no longer gripped except in the nip of the first stand of said rolling mill.

4. The method as claimed in claim 1, whereby at least two of said values representative of the lateral position of the strip are values delivered by sensors placed downstream of the corresponding rolling mill stands.

5. The method as claimed in claim 4, whereby at least one of said values representative of the lateral position of the strip is a value calculated from the values delivered by said sensors placed downstream of the other rolling mill stands, the other representative values being the values delivered by said sensors.

6. The method as claimed in claim 5, whereby said calculated value of the lateral position of the strip is obtained by using the parameters of said gain matrix K.

7. The method as claimed in claim 4, whereby all the values representative of the lateral position of the strip are values measured by said sensors, one in number downstream of each stand of said rolling mill.

8. The method as claimed in claim 4, whereby said values delivered by said sensors are obtained by filtering the raw acquisition signals, said filtering taking into account the calculated differences between said lateral positions of the strip and the reference position.

9. The method as claimed in claim 1 whereby, when an additional tilt to be imposed is below a predetermined threshold, no additional tilt setting is transmitted to the stand in question.

10. The method of rolling a strip as claimed in claim 1, whereby, when said strip is no longer gripped in the nip of the first stand of said rolling mill, the lateral position of that part of the strip still gripped in the nips of at least two stands of the rolling mill and a pivot angle relative to the rolling axis of the tail of the strip are both adjusted, by calculating and transmitting an additional tilt value to each stand in which the strip is still present.

11. The method as claimed in claim 10, whereby, for each stand, the additional tilt value to be applied is determined using a value representative of said pivot angle of the tail of the strip upon entering the stand.

12. The method as claimed in claim 11, whereby said value representative of said pivot angle is calculated by means of values representative of the lateral position of the strip along a line transverse to its run direction, in said stands in the nips of which the strip is gripped, said representative values being obtained by using the parameters of the gain matrix K.

13. A device for adjusting the lateral position of a strip in a rolling mill for metal products, which mill has at least two stands, in the nips of which said strip is simultaneously gripped, said device comprising:

at least two sensors delivering a raw acquisition signal for determining values representative of the lateral position of the strip along a line transverse to a run direction downstream of at least two stands of said rolling mill;

means for determining algebraic differences between said representative values and a reference position;

means for calculating the value of additional tilt to be imposed on each of said stands of the rolling mill from said differences so as to bring said algebraic differences below a predetermined threshold;

means for calculating a gain matrix K to obtain said additional tilt values by multiplying said differences by said matrix K; and means for transmitting the respective additional tilt setting to each of said rolling mill stands at predetermined time intervals.

14. The device as claimed in claim 13, which further includes means for filtering the raw acquisition signals from said sensors.

15. The device as claimed in claim 13, wherein each of the means includes a processing unit.

16. A rolling mill, for rolling metal products in strip form, comprising at least two stands and at least one device for adjusting the lateral position of the strip as claimed in claim 13.

17. The rolling mill as claimed in claim 16, which further includes at least one device for adjusting the position of the tail of said strip.

18. The rolling mill as claimed in claim 16, wherein the rolling mill is a finishing mill for the hot rolling of steel strip.

19. The rolling mill as claimed in claim 18, comprising two, five, six or seven rolling stands.

20. The rolling mill as claimed in claim 16, wherein the rolling mill is a mill for the cold rolling or skin-pass rolling of steel strip.

21. The rolling mill as claimed in claim 20, comprising two, three, four or five rolling stands.

* * * * *